US005313686A

United States Patent [19]

Berfield

[11] Patent Number: 5,313,686

[45] Date of Patent: May 24, 1994

[54] TOOL CADDY FOR ATTACHMENT TO CONTAINER, PARTICULARLY FOR A VACUUM CLEANER TANK

[75] Inventor: Robert C. Berfield, Jersey Shore, Pa.

[73] Assignee: Shop-Vac Corporation, Williamsport, Pa.

[21] Appl. No.: 784,924

[22] Filed: Oct. 30, 1991

[51] Int. Cl.[5] ..... A47L 9/00

[52] U.S. Cl. ..... 15/323; 15/327.6; 15/339; 16/29; 16/31 R; 16/32

[58] Field of Search ..... 15/327.6, 323, 339, 15/353; 16/29, 31 R, 30, 32

[56] References Cited

U.S. PATENT DOCUMENTS

| | | | |
|---|---|---|---|
| 2,819,485 | 1/1958 | Sparklin | 15/323 |
| 2,917,769 | 12/1959 | Kasper | 15/323 |
| 2,920,337 | 1/1960 | Smith | 15/323 |
| 3,089,177 | 5/1963 | Andersson-Sason | 15/323 |
| 3,721,071 | 3/1973 | Mueller et al. | 15/323 X |
| 3,732,667 | 5/1973 | Fromknecht et al. | 15/327.6 X |
| 4,783,878 | 11/1988 | McCambridge | 15/327.6 |
| 4,827,564 | 5/1989 | Brown | 16/317 R X |
| 4,845,793 | 7/1989 | Meyer | 15/323 X |
| 4,888,849 | 12/1989 | Hult et al. | 15/353 X |

OTHER PUBLICATIONS

Pow-R-Vac, *Distributor Price List,* Aug. 1, 1981.

Fakir, *Complete Programme* 1990, 1990.

Advertisement for Genie VACaRoo?, 1989.

Advertisement for Eureka PowerTwin Wet/Dry 2850, 1988, distributed by The Eureka Company.

Advertisement from *DM,* "Introducing a Complete Line of Extractor and Wet-Dry Vacs From Eureka." Jan. 1989, pp. 25-26.

Alta "Product Catalog", effective Mar. 1, 1991, pp. 13 and 144.

*Primary Examiner*—Chris K. Moore

*Attorney, Agent, or Firm*—Marshall, O'Toole, Gerstein, Murray & Borun

[57] ABSTRACT

A caddy is placed on a tank where the tank has receptacles beneath it for removably receiving casters. The caddy has support elements which are spaced apart at the spacing of the receptacles around the tank and the caddy being adapted to be placed on the tank with the support elements thereof removably fastened at the receptacles beneath the tank. A plurality of the receptacles around the tank enable the caddy to be placed at various positions around the tank. The invention is particularly useful with the tank of an electric vacuum cleaner.

11 Claims, 5 Drawing Sheets

FIG. 1
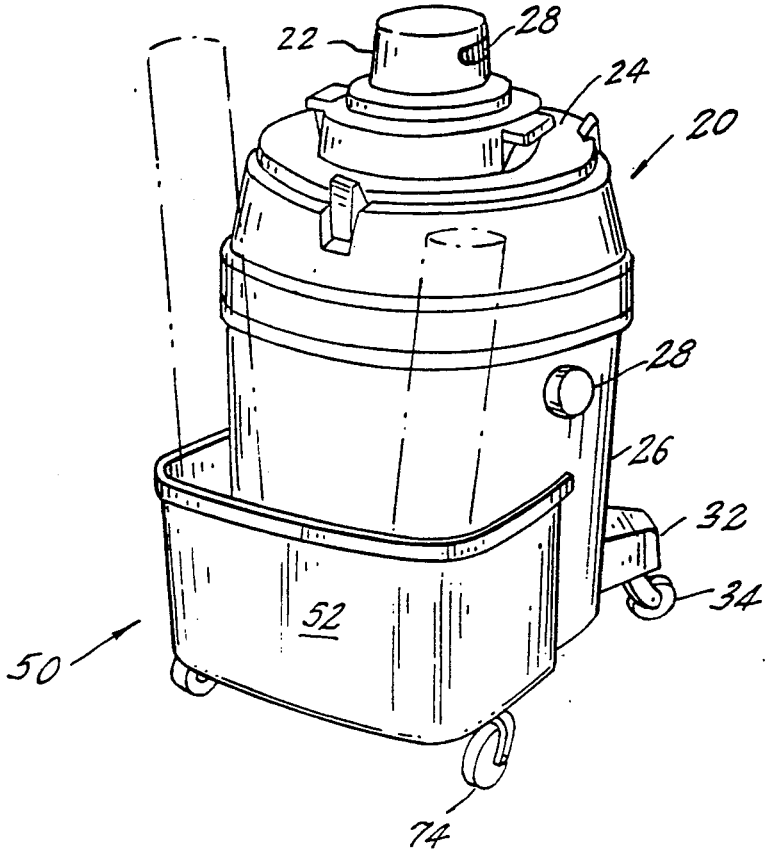
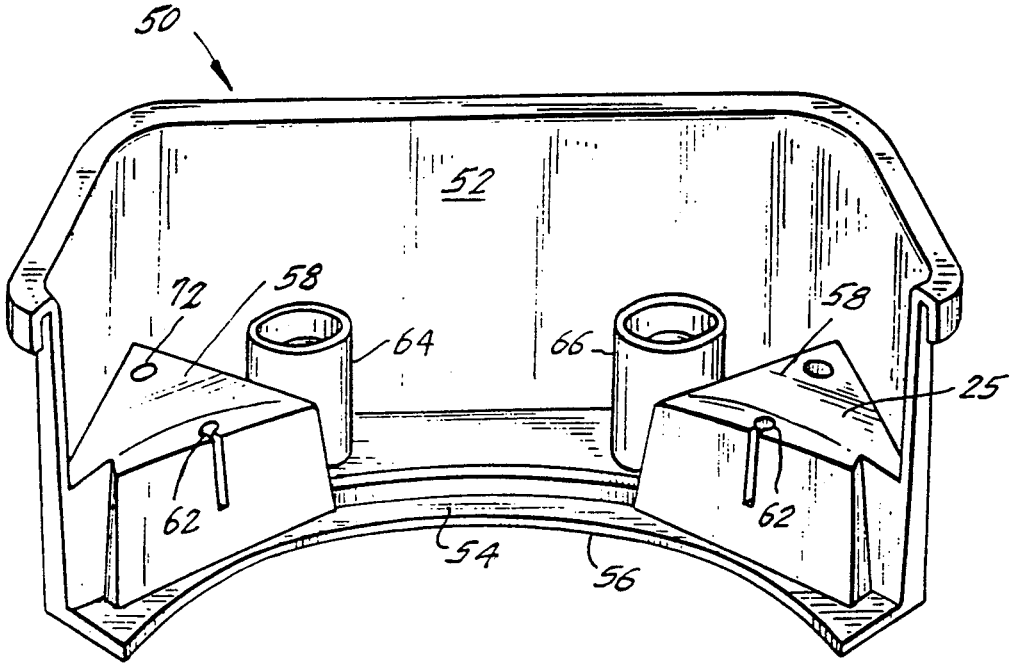
FIG. 2

FIG. 3.
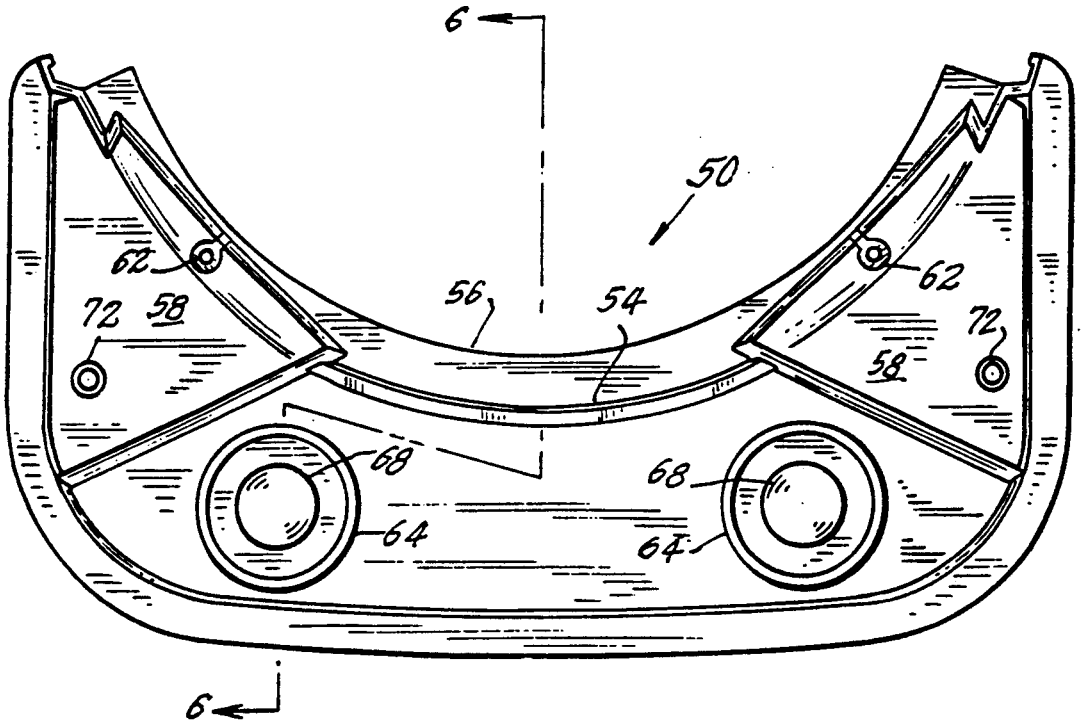
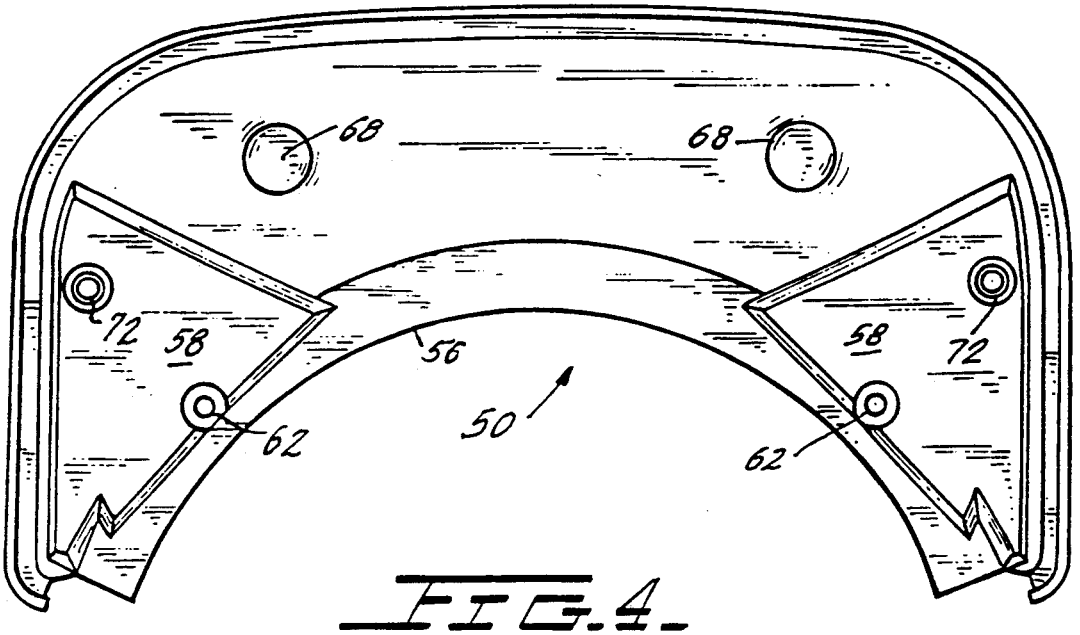
FIG. 4.

FIG. 9
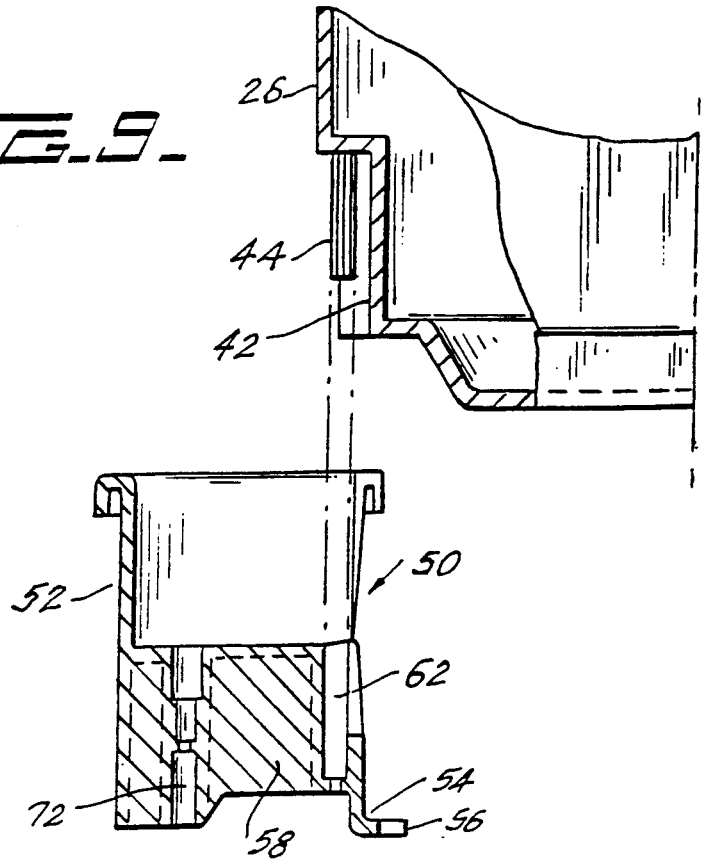
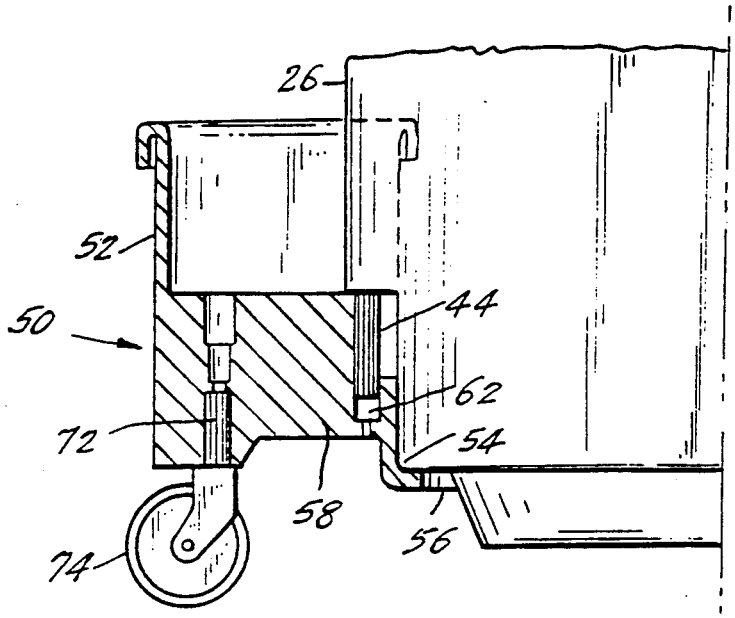
FIG. 10

TOOL CADDY FOR ATTACHMENT TO CONTAINER, PARTICULARLY FOR A VACUUM CLEANER TANK

BACKGROUND OF THE INVENTION

The present invention relates to a tool caddy attachable to a vessel or tank and which is particularly useful for attachment to the tank of a tank type vacuum cleaner.

Tank type vacuum cleaners include a blower motor for moving air, an air outlet from the blower motor for blown air and an air inlet to the blower motor for filtered air. The motor sits on a tank and its air inlet communicates into the tank. Air and entrained materials are sucked through an inlet hose into the tank where the air speed slows and the heavier collected materials fall. Then the air passes through a filter and through the blower motor. The collected materials tank can be of almost any size. Some are sufficiently large that they are moved about on a dolly or roll on casters or wheels placed beneath the tank. Especially where the tank type vacuum cleaner is capable of wet material or liquid pick up, as the tank becomes filled, it rapidly becomes quite heavy, requiring wheels under the tank to move it.

Especially with the tank of a vacuum cleaner, there are various exchangeable or interchangeable tools, especially for installation at the tank inlet. For example, a hose may be connected to the suction inlet to the tank. Various rigid tubes and wands and nozzles may be attached to or in place of the hose and various tools and nozzles may be attached to the hose or wand. Also, the vacuum cleaner may be used in association with additional cleaning tools, e.g. a brush or broom or other tool which moves, or loosens, or the like some of the dirt to be suctioned. It would be convenient to have needed tools right at the vacuum cleaner and to move them around with the vacuum cleaner.

Various tool carriers or caddies are known for being attached to various parts of the vacuum cleaner, e.g. to its tank, its handle, etc. for transporting tools along with the vacuum cleaner. The invention is described for use with a tool caddy and for a vacuum cleaner. But, the invention is useful for other applications, like other tanks or vessels requiring other items be fastened to them.

SUMMARY OF THE INVENTION

It is an object of the present invention to provide a tool caddy to be associated with a tank, particularly the tank of a tank type vacuum cleaner, so as to be moveable with the tank.

Another object of the invention is to provide a caddy which is to be attached to a tank which is moveable by being rolled on casters.

A further object of the invention is to provide a caddy which can be mounted at various positions around the tank.

Another object of the invention is to provide a caddy which is adapted to be associated with or to replace one or more supports, particularly movement supporting casters, of the tank.

The caddy of the invention is associated with a tank which is generally cylindrically shaped. A tank of molded plastic construction is described because it can be formed, e.g. by molding, to have receptacles for tank support means, such as casters, or for attachment of the caddy to the tank. But other materials may be used to form the tank if the noted receptacles can be formed in the tank. At various locations around the underside of the tank, e.g. at 90° intervals around a circular tank, the tank has a receptacle for a respective support means, like a caster or a support housing for a caster, that is installed in the receptacle. Another type of tank support means even a non-moving leg, may be installed in the receptacle, rather than the caster. Alternately, the tank may be placed on a platform which has the above noted receptacles beneath it. The caster or the caster housing is removable from the respective receptacle beneath the tank to enable installation of the caddy.

The caddy is typically a simple container placed at the exterior of the tank. One wall enclosing the caddy container comprises the exterior surface of the tank at the caddy. The remaining peripheral walls of the caddy define the internal shape of the caddy to enable it to receive and hold tools to be accessible to the user. The top of the caddy may be open.

The caddy extends up along the side of the tank. It is connected to the tank at the above noted tank support means receptacles. A fixture on the caddy extends into and is fastenable in at least one of the tank receptacles to hold the caddy at the tank.

The caddy will be supported in one and preferably in at least two of the support means receptacles. To fasten the caddy to the tank, the tank supports or casters or the caster housings are removed from the respective tank receptacles. The caddy has fixtures at its underside which extend to and fit into the receptacles beneath the tank to fasten the caddy to the tank. The underside of the caddy, in turn, has respective support means receiving receptacles for receiving the removed casters, or other appropriate supports or caster substitutes.

Within the caddy enclosure, there may be small shaped tool receptacles, e.g. small diameter receptacles, which can hold the tubes, wands or nozzles used in association with the vacuum cleaner and its tank.

Other objects and features of the present invention will become apparent from the following description of the preferred embodiment thereof considered in conjunction with the accompanying drawings.

BRIEF DESCRIPTION OF THE DRAWINGS

FIG. 1 is a front perspective view of a tank type vacuum cleaner with a tool caddy of the invention applied to it;

FIG. 2 is a perspective view into the interior of the caddy removed from the vacuum cleaner;

FIG. 3 is a top view of the caddy;

FIG. 4 is a bottom view of the caddy;

FIG. 9 is an exploded view showing the mounting of the caddy to the tank;

FIG. 10 is an assembled view showing an assembly of the caddy to the tank.

DESCRIPTION OF THE PREFERRED EMBODIMENT

Figure 5:
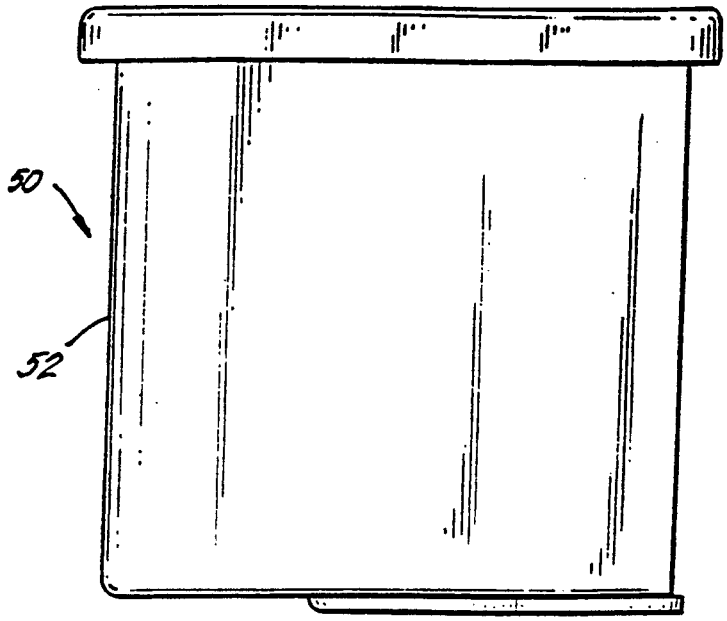
FIG. 5 is a side view of the caddy.

FIG. 1 shows a standard electric motor operated wet and dry material pick up vacuum cleaner, which is well known in the art and is therefore not further described. There is the standard blow motor 22 at the top which is supported on a lid 24 which is clipped to the open top of a generally cylindrical or barrel shaped collecting tank 26. There is an inlet port 28 at the side of the tank to which a hose, tube, wand, or the like may be installed. A filter is disposed in the tank at an inlet to the motor so that air that is sucked into the tank is filtered before being drawn into the motor. The motor has an outlet port 29 for the air. Materials drawn through the inlet port 28 with the air settle into the tank 26 in the usual manner.

As the tank fills, it becomes heavy. At four equally spaced intervals around the underside of the tank, there are respective tank support means, particularly caster housings 32 which hold rolling casters 34 beneath them to support the tank so that the tank can be rolled around.

Figure 8:
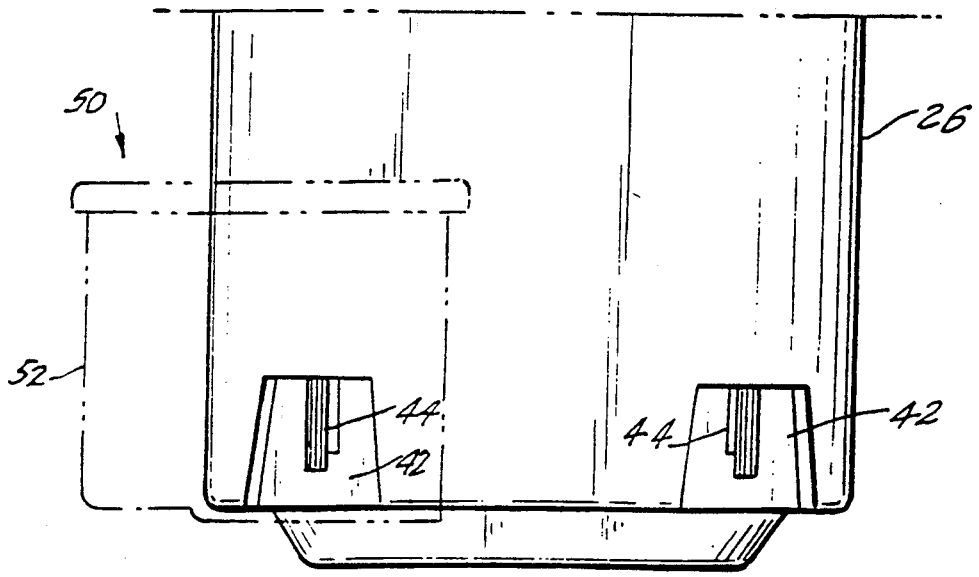
FIG. 8 is a side view of the tank showing a caddy partly in phantom to indicate the relative positioning between the caddy and the tank.

FIGS. 8 and 9 illustrate the receptacles 42 in the tank bottom in which the casters housings 32 are installed. The illustrated tank 26 is a one piece molded tank and the receptacles are molded into the tank. At four equally spaced intervals, the tank bottom has respective indented receptacle 42. A respective depending caster engaging or caddy engaging prong 44 extends down from the top wall of the receptacles. Other suitable receptacles and caddy engaging means may be substituted for either holding the casters or securing the caddy in the receptacles beneath the tank.

Referring to FIGS. 1 and 2, a caddy 50 has an open side toward the peripheral wall of the tank 26. The remaining peripheral walls 52 of the caddy complete the enclosure of the sides of the caddy when the caddy is installed around the tank. The caddy may have an additional wall enclosing the tank facing side. But, such a wall is not necessary. Like the tank, the caddy may be a one piece plastic molding. The floor 54 of the caddy has a concavely curved internal periphery 56 which mates with the periphery of the tank 26 so that the caddy can be pressed against the tank without leaving a space between them.

Molded under the floor 54 of the caddy, there are caddy mounting fixtures 58 which are spaced apart at 90° around the tank, corresponding to the locations of the caster housing receiving receptacles 42 beneath the tank. The fixtures 58 are intended to replace one or more of the caster housings. At the top sides of each fixture 58 an opening 62 is defined, which is placed and shaped to receive the respective depending prong 44 inside the respective receptacle 42 beneath the tank. By pressing the prong 44 into the opening 62, the fixture 58 is installed in the receptacle 42 beneath the tank which secures the caddy beneath the tank. Further, the caddy is prevented from separating from the tank as the tank is resting on top of the fixtures 58.

Figure 6:
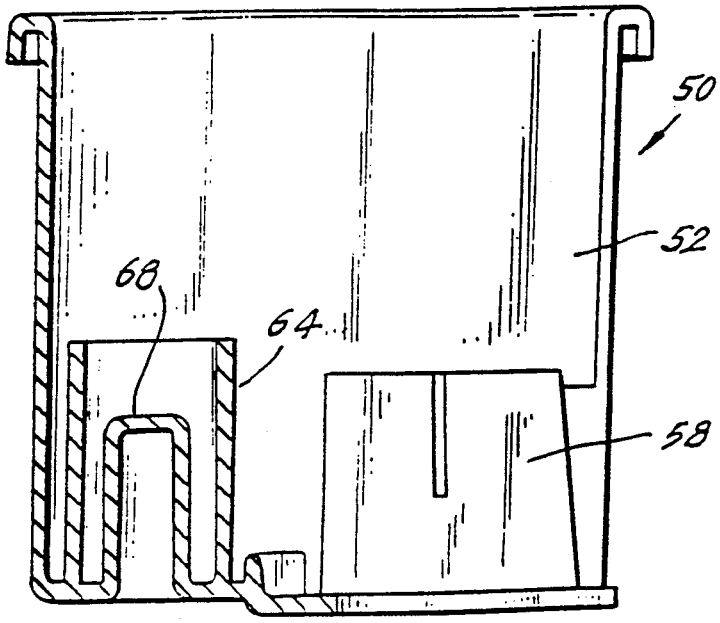
FIG. 6 is a cross-sectional view through the caddy along the path indicated by the arrows 6 in FIG. 3.
Figure 7:
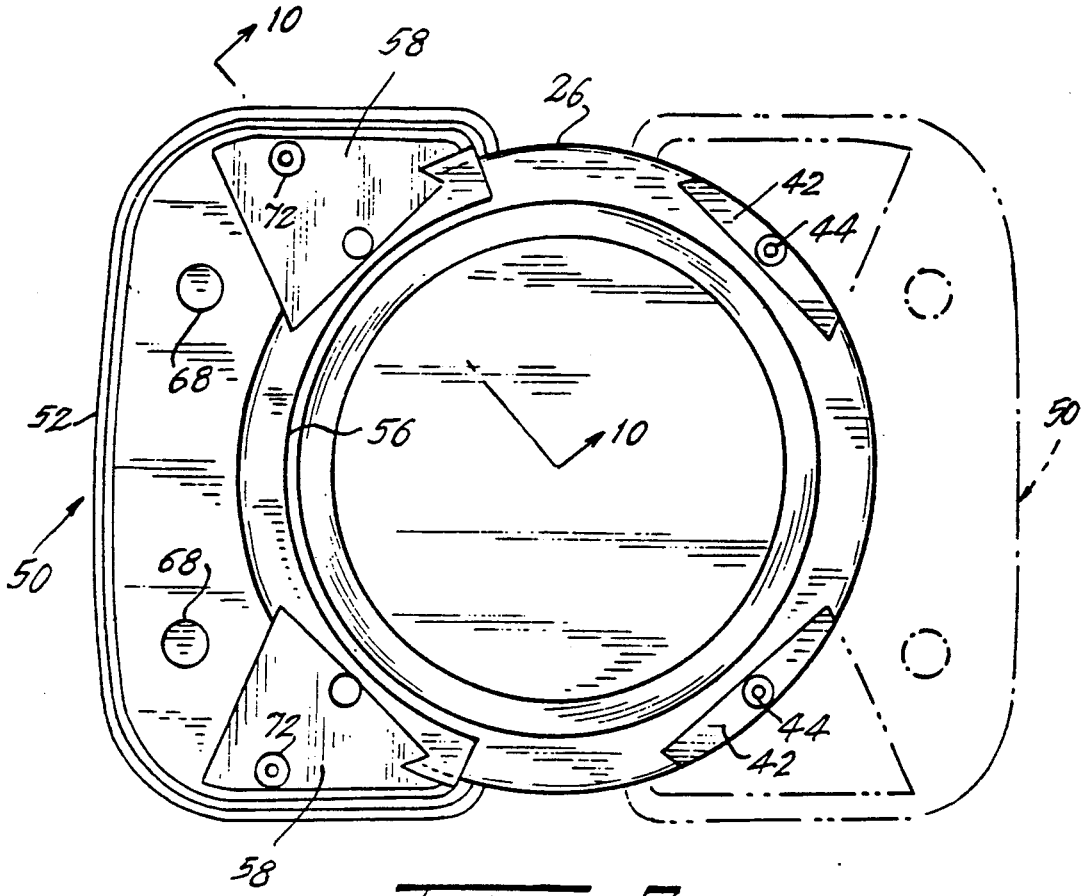
FIG. 7 is a bottom view of the tank with one or two caddies installed.

On the floor 54 of the caddy are defined two tubular receptacles 64, 66, which are spaced apart. As seen in FIG. 6, each of the tubes 64, 66 has a shorter post 68 within it. The tube 64, 66 may support a tool, as shown in FIG. 1, for example. The post 68 may be inserted into the end of the tool placed in the receptacle 64, 66 and support it upright. Otherwise, the tubes 64, 66 may be flat bottomed and empty inside, if desired.

As shown in FIGS. 9 and 10, the prong 44 is installed in the opening 62 in the caddy fixture 58. Radially outward of the opening 62, there is another opening 72 which is adapted to receive another caddy support means, like the shank of another caster 74 which is installed beneath the caddy to replace the caster which had been removed from the tank to enable installation of the caddy. In order to install the caddy 50 which has two spaced apart fixtures 58, two of the casters 32, 34 have to be removed for receiving the fixtures. The caddy illustrated can be placed at any one of four different positions around the tank, as the user may desire, by selecting which two of the casters 34 to remove to enable installation of the caddy fixtures 58. In FIG. 1, the caddy is to one side of the inlet opening 28. Alternatively, the caddy may be at the rear of the tank, opposite the inlet fixture 28, or it may be positioned directly in front of the inlet, at the user's option. As suggested in FIG. 9, it is possible to remove all of the original casters and to use two caddies at opposite sides of the tank.

The illustrated arrangement shows a caddy that covers two of the caster receptacles on the tank. A caddy that covers one or that covers more than two of the caster receptacles may be provided. Further, there need not be only four but there can be any number of caster receptacles and the caddy would be correspondingly configured to the placement and shapes of the caster receptacles.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A tank and a caddy for emplacement on the tank, comprising:

first fixtures disposed on the tank;

a plurality of removable means for supporting the tank wherein the first fixtures are adapted to receive the support means; and at least one second fixture disposed on the caddy adapted to be received by at least one of the first fixtures when tank support means are absent from at least one of the first fixtures, wherein the caddy has a caddy wall and the tank has a peripheral wall and wherein the caddy wall and peripheral wall define the interior of the caddy when the caddy is placed on the tank.

2. The tank and caddy of claim 1, further comprising third fixtures on the caddy and means for supporting the caddy wherein the third fixtures are adapted to receive the caddy support means.

3. The tank and caddy of claim 2, wherein the tank support means comprise a first set of casters.

4. The tank and caddy of claim 3, wherein the caddy support means comprise a second set of casters.

5. The tank and caddy of claim 4, wherein there are at least two of the first fixtures on the tank, wherein the caddy extends around the tank to the two first fixtures and wherein the second fixtures on the caddy are spaced apart, positioned and shaped to each be received by one of the at least two first fixtures.

6. The tank and caddy of claim 1, wherein there are at least two of the first fixtures on the tank, wherein the caddy extends around the tank to the two first fixtures and wherein the second fixtures on the caddy are spaced apart, positioned and shaped to each be received by one of the at least two first fixtures.

7. The tank and caddy of claim 6, comprising four of the first fixtures with pairs of the first fixtures being equally spaced around the tank, for enabling the caddy to be placed at various positions around the tank, and the caddy second fixtures can be received in two of the first fixtures at various positions around the tank.

8. The tank and caddy of claim 1, wherein the caddy further comprises supports for holding tools and the like at least one second fixture disposed on the caddy adapted to be received by at least one of the first fixtures when tank support means are absent from at least one of the first fixtures, wherein the caddy has a caddy wall and the tank has a peripheral wall and wherein the caddy wall and peripheral wall define the interior of the caddy when the caddy is placed on the tank.

9. The tank and caddy of claim 1, wherein each first fixture comprises a receptacle having a prong, and wherein each second fixture includes an opening in it for receiving the prong of a first fixture, for securing the caddy to the tank.

10. The tank and caddy of claim 1, wherein the caddy is shaped to define an enclosure adapted for containing tools used with the tank.

11. The tank and caddy of claim 1, wherein the tank is part of a vacuum cleaner, the vacuum cleaner including a blower motor positioned on the tank.

* * * * *